United States Patent [19]

Yu

[11] Patent Number: 4,583,229

[45] Date of Patent: Apr. 15, 1986

[54] METAL MELTING SYSTEM

[75] Inventor: Ho Yu, Murrysville, Pa.

[73] Assignee: Aluminum Company of America, Pittsburgh, Pa.

[21] Appl. No.: 569,128

[22] Filed: Jan. 9, 1984

[51] Int. Cl.[4] ..... H05B 7/00

[52] U.S. Cl. ..... 373/18

[58] Field of Search ..... 373/18–25; 219/121 P, 121 PA, 121 PB, 121 PU

[56] References Cited

U.S. PATENT DOCUMENTS

| | | | |
|---|---|---|---|
| 2,806,124 | 9/1957 | Gage . | |
| 2,922,869 | 1/1960 | Giannini | 373/18 X |
| 3,147,329 | 9/1964 | Gage . | |
| 3,147,330 | 9/1964 | Gage . | |
| 3,194,941 | 7/1965 | Baird . | |
| 3,422,206 | 1/1969 | Baker et al. . | |
| 3,783,167 | 1/1974 | Tylko . | |
| 4,239,740 | 12/1980 | Harvey, II et al. . | |
| 4,263,468 | 4/1981 | Primke et al. . | |
| 4,340,420 | 7/1982 | Santen et al. | 373/18 X |
| 4,361,441 | 11/1981 | Tylko . | |

OTHER PUBLICATIONS

"Technological Uses of Low Temperature Plasmas", *Physics in Technology,* Sep. 1975, vol. 6, No. 5, pp. 190–196, J. Lawton.

*Primary Examiner*—Roy N. Envall, Jr.
*Attorney, Agent, or Firm*—Brian D. Smith

[57] ABSTRACT

A method and apparatus for heating and melting electrically conductive material are disclosed. The method includes the steps of heating a jet of gas or gaseous mixture, directing a heated jet of gas or gaseous mixture to the material, and drawing a diffuse current through said gas jet to said material by seeding it with an additive having a low ionization potential so as to increase the rate at which the material is heated. The apparatus includes means for heating gas(es), means for directing a jet of said gas(es) to the material, means for introducing an additive having a low ionization potential into the gas(es) for purposes of ionizing said gas(es), and means for drawing a diffuse current through the jet of ionized gas to the material.

13 Claims, 2 Drawing Figures

METAL MELTING SYSTEM

BACKGROUND OF THE INVENTION

The invention relates generally to a novel method and apparatus for heating material, and more particularly, to a method and apparatus for melting metal, particularly aluminum, wherein the rate of heat transfer to the melt is greater than that obtainable with prior known melting methods.

Conventional melting techniques for metal, particularly aluminum and aluminum scrap, utilize natural gas reverberatory furnaces wherein heat is transferred to the melt primarily by radiation. Such processes are inefficient with, at best, only 30% of the heat of combustion ending up as useful heat in the liquid metal.

It is also known that metal can be heated or melted in furnaces utilizing electric arcs as a heat generating means. U.S. Pat. No. 3,147,329 to Robert Gage describes two conventional electric arc heating methods. One method (referred to as the nontransferred method) comprises a device or torch having two electrodes which heats the material to be melted by exposing it to radiation emanating from an electric arc generated between the electrodes. Alternatively, the material may be heated by exposing it to a gas stream having been heated by the arc as it passes therethrough. The second method described by Gage is referred to as the transferred arc heating method. In this method, the melt itself acts as an electrode which permits the direct transfer of energy from the arc to the melt, thereby heating the melt by resistance heating.

Both the transferred and nontransferred methods are plagued with difficulties when melting metal, particularly aluminum. The nontransferred arc heating methods, such as that found in conventional plasma arc torches, suffer from low heat transfer efficiencies. The transferred arc heating methods, such as those found in arc furnaces, have problems with electrode consumption, furnace refractory damage, product contamination, hot spots, and more significantly, reduced product recovery or melt loss resulting from undesirable vaporization of the melt caused by the high temperatures and localized high currents associated with the arc discharge of these methods.

Aluminum is a difficult metal to melt because its relatively low melting temperature causes it to vaporize rather easily. Such vaporization is undesirable because vaporized aluminum is rather difficult to condense and recover. Scrap aluminum, which generally contains large quantities of aluminum beverage cans having ends made of high magnesium Aluminum Association alloy 5182, is particularly difficult to melt because the magnesium of AA 5182 tends to ignite easily and start fires in the melting furnace. Such fires are undesirable, quite obviously, because they can result in the loss of significant amounts of aluminum, thereby substantially reducing product recovery.

Accordingly, an object of the present invention is to provide a method and apparatus for heating material wherein material loss through vaporization and combustion is minimized.

Another object of the invention is to provide a method and apparatus for heating material having high heat transfer efficiency.

Yet another object of the invention is to provide a method and apparatus for melting recycled aluminum scrap wherein combustion of aluminum and magnesium contained in the scrap is minimized.

These, as well as other objectives, will become apparent from a reading of this disclosure and the claims and an inspection of the accompanying drawings appended hereto. In accordance with the above objectives, the present invention provides a method of heating electrically conductive material. The method includes the steps of heating a jet of gas or gaseous mixture, directing the heated gas jet so as to make contact with the material, and drawing a diffuse current through said gas jet to said material by seeding it with an additive having a low ionization potential so as to increase the rate at which the material is heated, preferably without vaporizing the material.

The apparatus of the present invention for heating electrically conductive material comprises means for heating gas(es), means for directing a jet of said gas(es) to the material, means for introducing an additive having a low ionization potential into the gas(es) for purposes of ionizing said gas(es), and means for drawing a diffuse current through the jet of ionized gas to the material.

Diffuse current, as used herein, refers to the relatively uniform flow of electrical current throughout the cross section of the aforementioned gas jet, the amount of current in accordance with the present invention being below that value that would result in arc breakdown voltage.

DETAILED DESCRIPTION

Any electrically conductive material may be heated or melted by the present invention; however, the invention is particularly well suited to melting metals having relatively low melting points, such as aluminum, and in the embodiment described clean particles of aluminum scrap containing AA 5182 and other aluminum alloys are melted.

Figure 1:
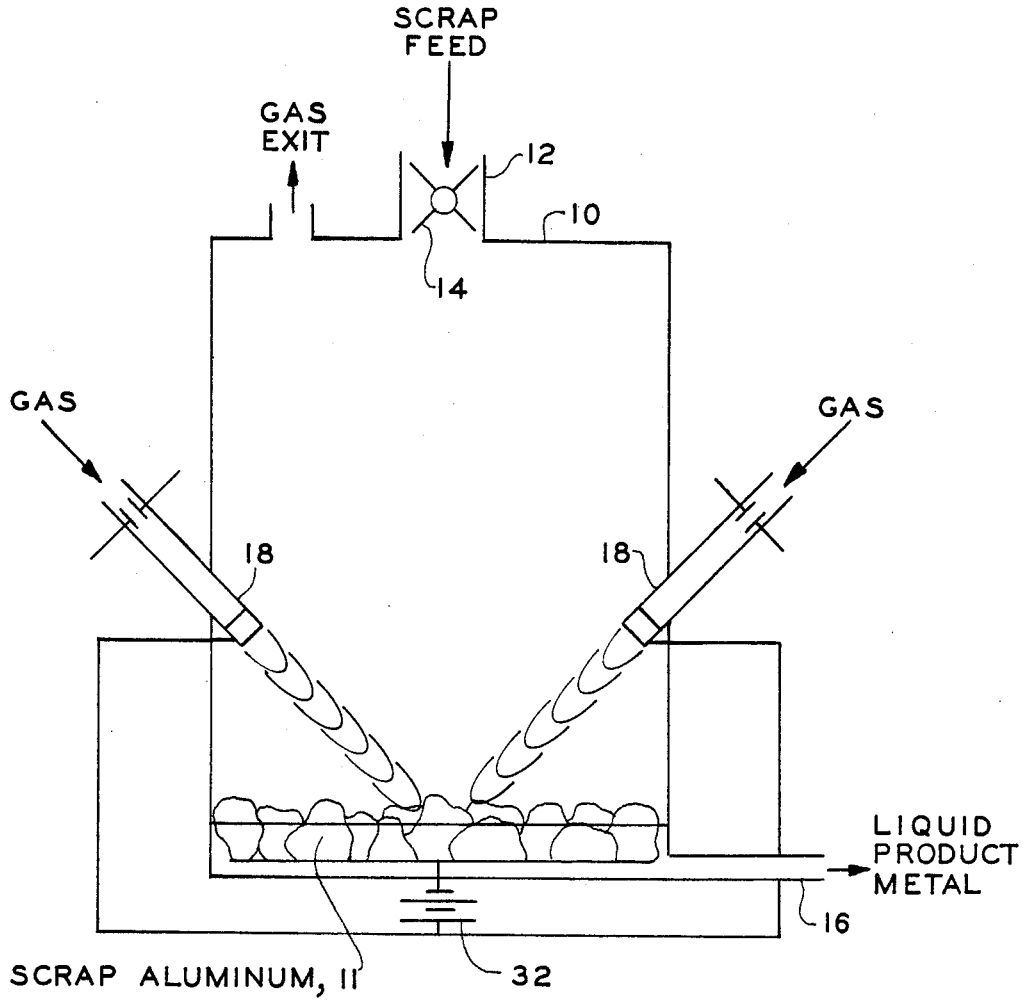
FIG. 1 is a schematic vertical section of a furnace embodying the invention.
Figure 2:
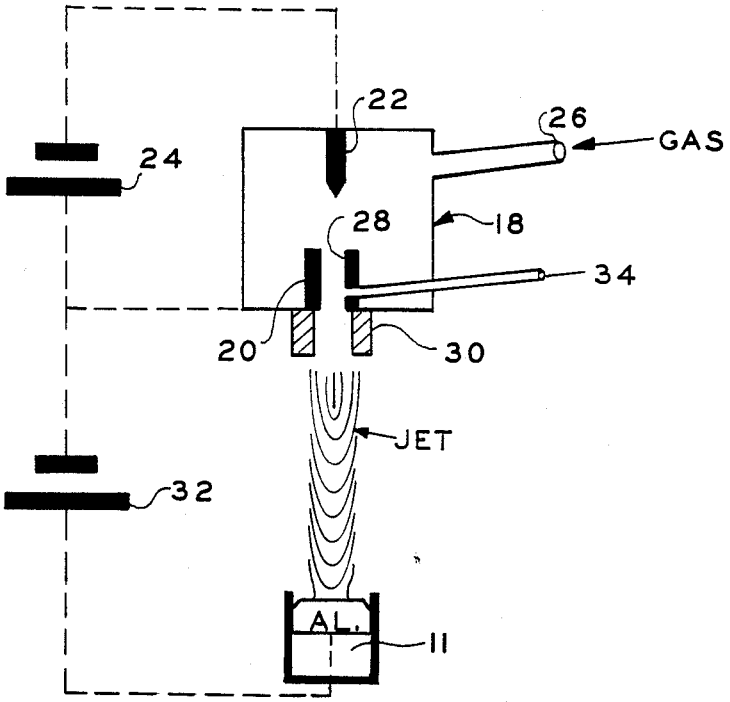
FIG. 2 is an exploded, schematic view of the torch, melt and power supplies depicted in FIG. 1.

Referring now to FIG. 1, there is shown a furnace 10 in which aluminum scrap 11 is melted in accordance with the present invention. Furnace 10 has a scrap inlet 12 which, as its name suggests, provides a passageway for charging the furnace with scrap metal 11. Housed within inlet 12 is a revolving gate 14 which is controlled to regulate the flow of scrap charged to the furnace. Gate 14 also partially obstructs the entry of air into the furnace and the exit of gas from the furnace, thereby enabling some measure of control over furnace atmosphere for purposes of minimizing metal loss due to oxidation. The bottom of furnace 10 is provided with a metal tap outlet 16 for tapping molten metal from the furnace. Housed in two opposing side walls of furnace 10 are plasma torches 18, the components of which are illustrated in FIG. 2 which provides an exploded view of a plasma torch 18.

Torch 18 is similar to a conventional nontransferred type torch in that it has both an anode 20 and a cathode 22 and is powered by a conventional power supply means 24. Gas enters the torch through a gas inlet 26 and is heated in a conventional manner as it passes through an arc (not shown) created between the torch anode and cathode. The heated gas is then directed out of the torch arc area through an opening 28 provided in anode 20. A torch nozzle 30 receives the heated gas exiting opening 28 and directs it in the form of a gas jet towards the metal charge 11 so as to make contact with and melt the metal charge.

While torch 18 resembles a nontransferred type torch, those skilled in the art will recognize that it is different in that it has an external electrical circuit which is powered by an external power supply means 32. As can be seen in FIG. 2, one terminal of power supply means 32 is connected to torch anode 20 with the other end connected to the scrap matal charge. This setup is similar to those commonly found in transferred type arc heating methods wherein the melt serves as an electrode and an arc discharge occurs between the melt and the other electrode. The discharge of electrical energy which occurs from anode 20 to the metal charge is, however, quite different from the highly constricted arc discharges of conventional transferred type methods which are extremely hot and unstable because of the arcs' concentrated nature. Such hot discharges are undesirable because they can vaporize the metal being melted and ignite magnesium present in the scrap, which can cause furnace fires, both of which reduce process efficiency and metal recovery rates. Arc instability, which can be described as uncontrollable jumping or fluctuating of the arc, is also undesirable because directional control over the arc is difficult and damage to the furnace walls can result if contact therewith is made by the arc.

In contrast to conventional arc discharges, the discharge of the present invention is more spread out or diffuse. That is, current flow is not nearly as concentrated as it is in a narrowly constricted arc discharge. Electrons flow more uniformly over a wider cross-sectional area of the gas jet exiting the torch and, as such, make contact with a broader area of the molten metal surface. Because of this broader, more diffuse discharge, the electrical energy being transferred is cooler than it is when being channeled through a narrowly constricted arc. Accordingly, less metal loss through vaporization and combustion is possible.

The cool, diffuse transfer of electrical energy also enables higher heating or melting rates by directly transferring the discharge's electrical energy to the melt (where the charge is melted by resistance heating) in addition to the transfer of thermal energy which is radiated to the metal charge in conventional nontransferred manner by the heated gas exiting the torch. Thus, it can be seen that the high heating rates of the present invention are made possible, in part, from the invention's novel use of both transferred and nontransferred type heating techniques.

Those skilled in the relevant art will appreciate that increased melting rates are possible with the present invention by (1) heating the gas carrying the diffuse cuurent to as high a temperature as is possible without vaporizing or volatizing significant amounts of metal, and by (2) maximizing the amount of diffuse current that can be drawn through the gas to the metal, again without vaporizing or combusting significant amounts of metal.

The diffuse current discharge is also believed to enhance heating rates by uniformly heating the gas jet across its cross section as it travels towards the melt. This is possible, as previously mentioned, because of the rather uniform flow of current across the gas jet's cross section. Without such current flow (as in nontransferred type methods), the gas stream approaching the melt cools down more quickly. Such cooling is primarily attributable to radiant heat loss to the furnace atmosphere. Heat transfer rates are also enhanced by a stirring of the melt which is induced by the magnetic field associated with the flow of current through the melt. p The diffuse current discharge of the present invention is provided by seeding the gas jet contacting melt 11 with a seed additive having a low ionization potential and by drawing a level of current through the seeded gas to the melt such that arc breakdown voltage is not reached. As can be seen in FIG. 2, the seed additives are fed into the gas jet through seed inlet 34 provided in torch anode 20. The seed additives enable the gas to ionize and thereby become electrically conductive at temperatures lower than it would without such additives. For example, unseeded argon normally does not ionize until it is heated to a temperature of 5000° Kelvin. However, when ionized with 1 wt.% potassium hydroxide, it will ionize at a temperature of about 3000° Kelvin. Seed additives providing satisfactory results in accordance with the present invention include Ce, K, Na, Ca and Al. Gases having high thermal conductivities and providing satisfactory results in accordance with the present invention include Ar, $N_2$, CO, $H_2$, $CH_4$ and $CO_2$.

Preferred results for melting scrap aluminum containing high magnesium alloys in accordance with the present invention are possible by seeding a 50 vol.% $H_2$/50 vol.% Ar gas mixture having been heated to a gas nozzle exit temperature of about 3000° Kelvin with 1 wt.% of K seed material, such as KOH or KCL. Diffuse current flow should be maintained at a high level; however, not so high as to cause substantial melt loss, whether through vaporization or combustion of aluminum or magnesium contained in the melt.

While the invention has been described in terms of preferred embodiments, the claims appended hereto are intended to encompass all embodiments which fall within the spirit of the invention.

What is claimed is:

1. A method of heating electrically conductive material comprising:

directing a heated jet of gas or gaseous mixture to said material;

providing an electrical contact in the heated jet of gas, said contact being electrically connected to an electrical power source which is also electrically connected to said conductive material; and seeding said jet of gas with an additive having a low ionization potential which is sufficient to draw diffuse current through said jet of gas from the contact to said material, said diffuse current increasing the rate at which the material is heated.

2. The method as recited in claim 1 wherein the gas is heated to a high temperature, but not so high as to cause substantial vaporization or combustion of the material being heated.

3. The method as recited in claim 1 wherein the material being heated is aluminum or an alloy thereof.

4. A method of melting aluminum or an alloy thereof comprising:

directing a heated jet of gas or gaseous mixture towards a melt containing aluminum or an alloy thereof;

providing an electrical contact in the heated jet of gas, said contact being electrically connected to an electrical power source which is also electrically connected to said melt; and seeding said jet of gas with an additive having a low ionization potential which is sufficient to draw diffuse current through said gas from the contact to the melt, said diffuse current increasing the rate of melting.

5. The method as recited in claim 4 wherein the gas jet is heated to a high temperature, but not so high as to cause substantial vaporization or combustion of the melt.

6. The method as recited in claim 5 wherein the gas jet bein heated has a nozzle exit temperature of about 3000° K.

7. The method as recited in claim 4 wherein the additive is selected from the group consisting essentially of Ce, K, Na, Ca and Al.

8. The method as recited in claim 4 wherein the gas is selected from the group consisting essentially of Ar, $N_2$, CO, $H_2$, $CH_4$ or $CO_2$.

9. The method as recited in claim 4 wherein the aluminum melt contains magnesium.

10. A method of melting aluminum or an alloy thereof comprising:

directing a gaseous jet of argon-$H_2$ having a nozzle exit temperature of about 3000° K. towards a melt containing aluminum or an alloy thereof;

providing an electrical contact in the heated jet of gas, said contact being electrically connected to an electrical power source which is also electrically connected to said melt; and seeding said jet of gas with an additive selected from the group consisting essentially of KOH or KCl which is sufficient to draw diffuse current through said gas from the contact to the melt, said diffuse current heating said melt.

11. The method as recited in claim 10 wherein the additive comprises about 1 wt.% of the argon-$H_2$ gaseous mixture.

12. The method as recited in claim 10 wherein the melt contains magnesium.

13. Apparatus for heating electrically conductive material comprising:

means for heating a gas or gaseous mixture;

means for directing a jet of said gas to said material;

means for introducing an additive having a low ionization potential into said gas for purposes of ionizing said gas;

means for drawing a diffuse current through said jet of ionized gas to the material, said means including a power source which is electrically connected to said material; and a contact in the heated jet of gas.

* * * * *

UNITED STATES PATENT AND TRADEMARK OFFICE

CERTIFICATE OF CORRECTION

PATENT NO. : 4,583,229

DATED : April 15, 1986

INVENTOR(S) : Ho Yu

It is certified that error appears in the above-identified patent and that said Letters Patent is hereby corrected as shown below:

References Cited:

| | |
|---|---|
| 2,806,124 | Insert --219/121--. |
| 3,147,329 | Insert --13/9--. |
| 3,147,330 | Insert --13/9--. |
| 3,194,941 | Insert --219/121--. |
| 3,422,206 | Insert --13/34--. |
| 3,783,167 | Insert --13/1--. |

UNITED STATES PATENT AND TRADEMARK OFFICE

CERTIFICATE OF CORRECTION

PATENT NO. : 4,583,229

DATED : April 15, 1986

INVENTOR(S) : Ho Yu

It is certified that error appears in the above-identified patent and that said Letters Patent is hereby corrected as shown below:

References Cited: (Continued)

| | |
|---|---|
| 4,239,740 | Insert --423/350--. |
| 4,263,468 | Insert --13/2--. |
| 4,361,441 | Insert --75/10--. |
| Col. 3, line 12 | Change "matal" to --metal--. |
| Col. 3, line 57 | Change "cuurent" to --current--. |
| Col. 4, line 6 | After "melt.", delete "p". |
| Col. 4, line 7 | Begin new paragraph: --The diffuse current...--. |
| Claim 6, Col. 5, line 12 | Change "bein" to --being--. |
| Claim 13, Col. 6, line 18 | Change "material" to --matter--. |

Signed and Sealed this

*Nineteenth* Day of *August 1986*

[SEAL]

*Attest:*

DONALD J. QUIGG

*Attesting Officer*

*Commissioner of Patents and Trademarks*